United States Patent [19]

Lin

[11] Patent Number: 4,775,093

[45] Date of Patent: Oct. 4, 1988

[54] FOLDABLE ASSEMBLY TYPE PLASTIC PACKAGE BOX

[76] Inventor: Kuo C. Lin, Room 203 No. 6-1, Ching Cheng St., Taipei, Taiwan

[21] Appl. No.: 38,984

[22] Filed: Apr. 16, 1987

[51] Int. Cl.[4] ..... B65D 5/46

[52] U.S. Cl. ..... 229/52 A; 229/52 AL; 220/94 R

[58] Field of Search ..... 229/52 A, 52 AL, 148, 229/16 A, 4.5, 5.5, 93, DIG. 6; 220/94 R

[56] References Cited

U.S. PATENT DOCUMENTS

| | | | |
|---|---|---|---|
| 1,123,432 | 1/1915 | Unversaw | 229/52 A |
| 2,158,697 | 5/1939 | Harrison | 229/52 AL |
| 2,405,310 | 8/1946 | Larkin | 229/52 A |
| 2,443,256 | 6/1948 | Lebold | 229/52 A |
| 2,645,406 | 7/1953 | Robins | 229/52 A |
| 2,807,407 | 9/1957 | Rosen | 229/52 A |
| 3,151,801 | 10/1964 | Vesak | 229/52 A |
| 3,208,478 | 9/1965 | Baines | 229/4.5 |
| 3,313,333 | 4/1967 | Lordi | 229/5.5 |

*Primary Examiner*—Willis Little

*Attorney, Agent, or Firm*—Bacon & Thomas

[57] ABSTRACT

A kind of foldable assembly type plastic package box is made up of the warping transparent plastic sheets which also form the handle. The box body plastic sheet and handle plastic sheet respectively form the box body and handle. The box body can be made up of one to three plastic sheets with cut grooves, cut lines, insertion and protruding ears, foldable trace and position-fixed trace, handle hole, which can be folded or squeezed into a square body or cylindrical box. The handle plastic sheet has the foldable trace or cut lines, and insertion and protruding ears that can be squeezed mutually to link together.

2 Claims, 4 Drawing Sheets

FOLDABLE ASSEMBLY TYPE PLASTIC PACKAGE BOX

BACKGROUND OF THE INVENTION (a) Field of the Invention

This Invention is related to the ordinary commercial package box; particularly it is made up of plastic material in flakes which can be folded into itself before it is disposed in use. It can also be assembled into a kind of package box.

(b) Description of the Prior Art

The ordinary commercial package boxes are mostly made up of cardboard paper. Firstly, the cardboard can be printed and, secondly, it is foldable so that it can be in the shape of a flat plate before it is disposed in use for convenience of storage. But the use of the cardboard paper has disadvantages. It is apt to be moistened and it is easily soiled or torn up and rendered opaque.

In recent years, it has been proposed to use injection molding to make a high quality transparent package box. Its advantage is to prevent water damage and its surface can be printed. It can also be reused. But such a box requires large space and the mold cost is very high.

SUMMARY OF INVENTION

A kind of foldable assembly type plastic package box is made up of warping transparent plastic sheets. Usually it can be divided into two parts: handle and box body. The square box body is made up of one sheet of plastic but the cylindrical box body must be composed by three plastic sheets. The box body plastic sheet is cut with a groove or the cut line for the folding trace provided for the insertion of protruding ear and handle hole for interfitting with each other to form a box body and also to allow the above mentioned handle to be inserted on the box body. It can be printed without fear of moistening,; it is washable and saves storage space. It can be reused for various purposes with some advantages.

DESCRIPTION OF THE PREFERRED EMBODIMENTS

The practical examples in the Invention are many. We hereby provide three drawings for reference. The practical example 1 and 2 are square in outer appearance. The large difference between the two is the handle. The practical example 3 is basically different.

Figure 1:
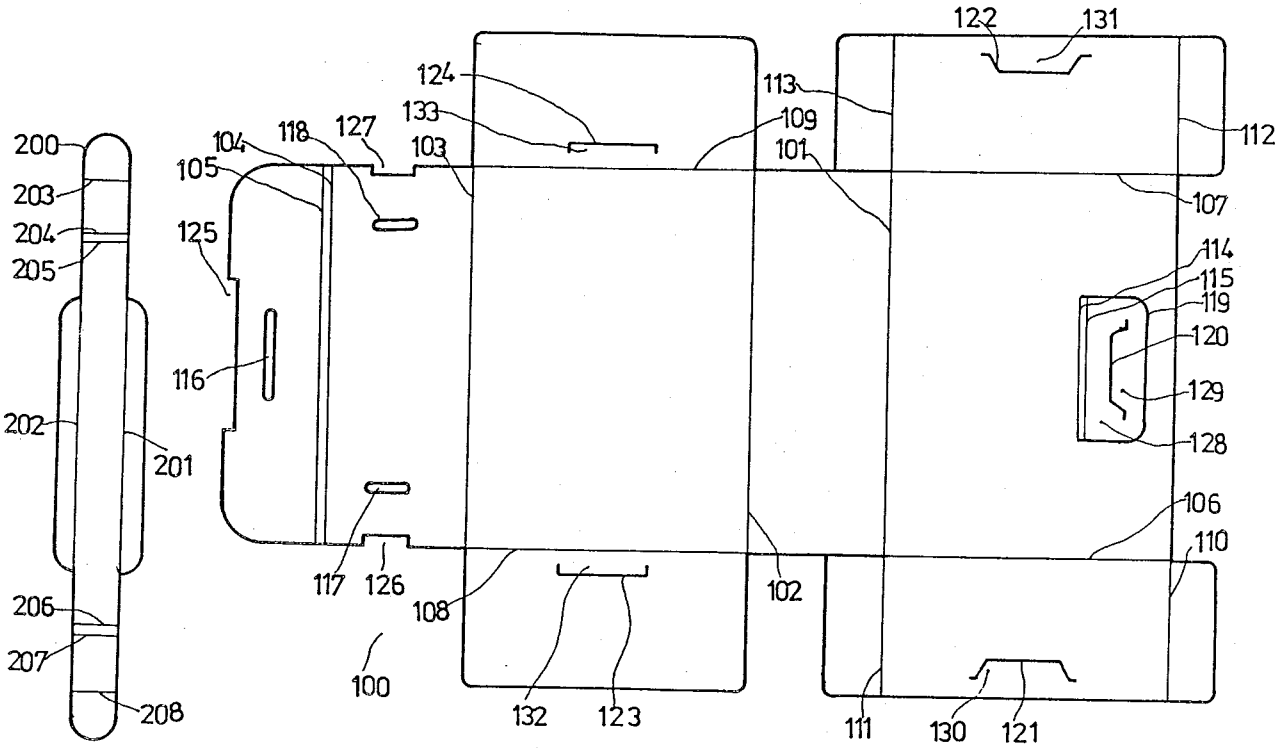
FIG. 1 shows an unfolded box according to a first embodiment of the Invention.

As shown in FIG. 1 the box body's plastic sheet in the practical example 1 (100) has installed 15 folding traces (101)–(115). Of them, the folding traces (101)–(113) can be folded into a box body (10) (See FIG. 2 and FIG. 3). There is another cut groove (116) and two holes (117) and (118) for a handle, and 6 U shape cut lines (119) to (124) and three U shape openings (125), (126) & (127). Thus they form 6 insertions and protruding ears (128) to (133). Of them, the cut lines (120) to (122) have two ends slightly protruding toward outside in extension for convenience of insertion of the protruding ears (129) to (131) dor support so that they would not be broken.

The practical example 1 has a plastic sheet's handle (200) located at the left side of FIG. 1. In the same manner, it has 8 cut traces (201) to (208). They are foldable into the handle (20) as shown in FIGS. 2 & 3.

Figure 2:
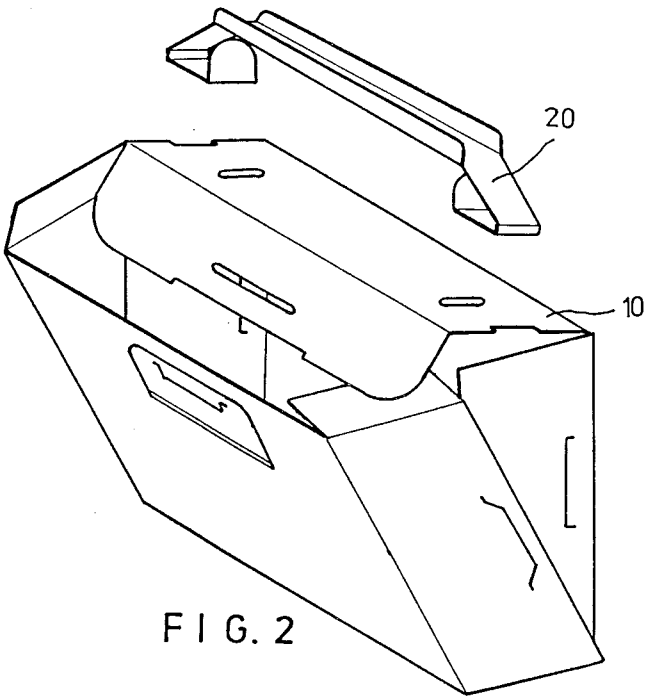
FIG. 2 shows the partially folded box of FIG. 1.
Figure 3:
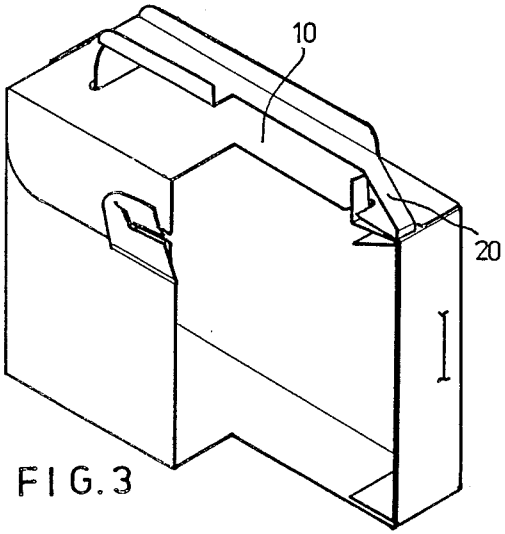
FIG. 3 is a partial sectional view of the box of FIG. 2.

As to the folding of the practical example 1, its assembly is as shown in FIGS. 2 & 3. It can be quickly operated for completion.

Figure 4:
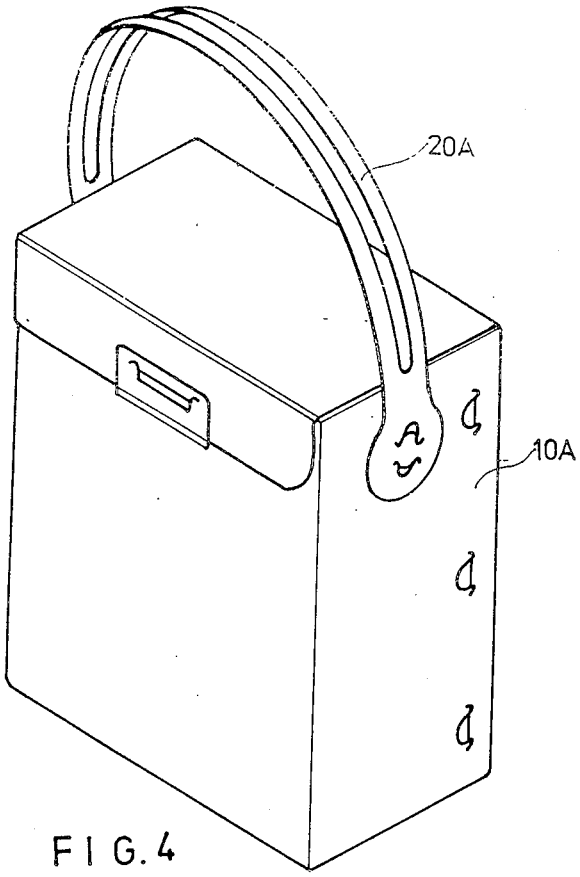
FIG. 4 is a perspective view of a second embodiment of the invention.
Figure 5:
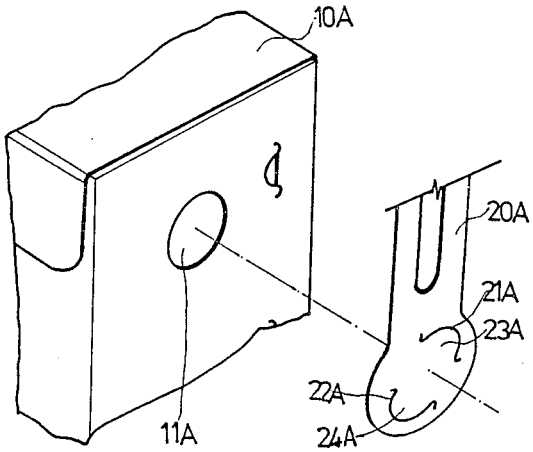
FIG. 5 depicts the assembly of the handle to the box of FIG. 4.

As shown in FIGS. 4 & 5. The practical example 2 in the Invention which is composed by the box body (10A) and handle (20A). The large difference between the practical example 1 and 2 is that the handle (20A) and box body (10A) are inserted in linkage. The remaining features are similar with only slight difference. As shown in FIG. 5, the end surface of the handle is in swell with the two cut lines in curve shape (21A) & (22A). The two curve cut lines (21A) (22A) have two ends respectively extending one cut line in curve shape on purpose to prevent the breaking. The handle (20A) is to use the cut lines in curve shape to produce protruding ears (23A) (24A) to be inserted into the holes (11A) of the box body (10A) which can also rotate.

Figure 6:
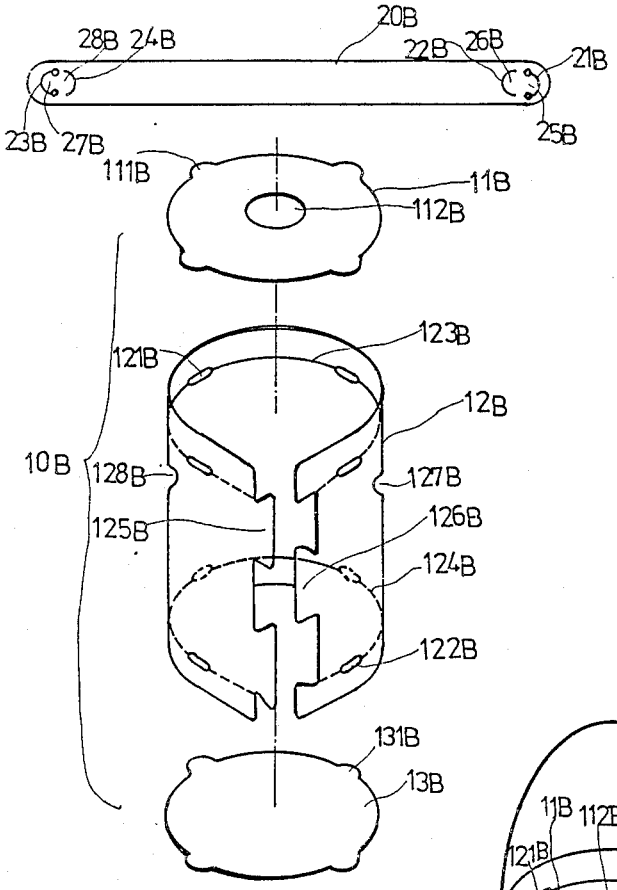
FIG. 6 is an exploded view of a third embodiment of the invention.
Figure 7:
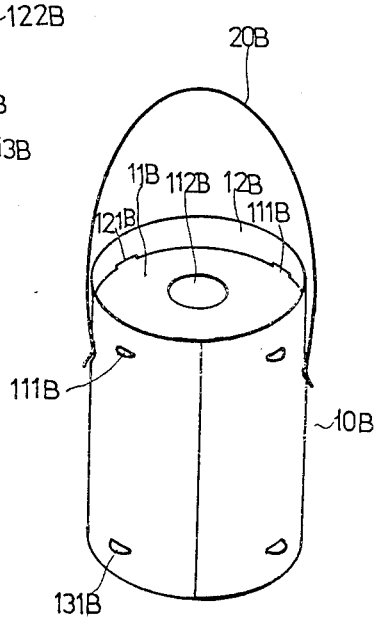
FIG. 7 is the folded box shown in FIG. 6.

As to the practical example 3, please refer to FIGS. 6 & 7. It is also a box body as shown in FIG. 7 and a handle (20B) to make it. The box body (10B) is made up of three sheets of plastic (11B), (12B) & (13B). Of them, the body's plastic sheets (11B) & (13B) respectively have 4 insertion and protruding ears (111B) (131B). In the above mentioned box body's plastic sheet (11B), there is another hole (112B) The upper and underside parts of the box body's plastic sheet (12B) have a row of corresponding cut groove respectively (121B) & (122B) and position trace in concave manner (123B) (124B). Besides, on the two ends of the box body plastic sheet (12B), a row of rectangular insertion and protruding ears (125B) (126B) are installed so as to make the box body plastic sheets assembled into a barrel shape. The box body plastic sheet (12B) used the above mentioned cut traces (121B) (122B) and position fixation concave traces (123B) (124B) respectively to unite with the box body plastic sheet (12B) in insertion and they thus are impacted.

There are other handle holes (127B) (128B) in the box body plastic sheets.

The two ends of the handle plastic sheet (20B) are respectively provided with two opposite cut lines in curve shape (21B) (22B) (23B) (24B). Of them, the two ends of the cut lines (21B) & (23B) are punched into two holes to prevent breakage. Hence the cut lines (21B) to (24B) are formed into insertion and protruding ears (25B) to (28B), thus being inserted into the box body plastic sheet (12B) handle holes (127B) & (128B).

In conclusion, the common feature in the Invention is the foldable trace, the cut lines for prevention of breaking and warping insertion and protruding ears etc.. The advantages are that the box can be folded to save space and it can be printed; it is moist proof and washable etc.

I claim:

1. A package box capable of being folded for use and unfolded for storage, and formed of moisture proof and printable material, which box comprises:

(a) a first sheet formed of plastic material and provided with a plurality of first traces defining lines along which the first sheet may be folded to form a rectangular-shaped box;

(b) the first sheet including:

(i) a plurality of corresponding ear and slit assemblies which may be detachably engaged for securing the first sheet in its folded position, (ii) a pair of opposed side walls, each side wall including a circular shaped aperture;

(c) a second sheet formed of plastic material and in the configuration of an elongate strap for defining a handle, each end of the strap including a pair of oppositely directed semicircular slits defining a pair of inwardly foldable semicircular-shaped locking ears; and (d) each end of the handle being securable to the box by inserting each pair of semicircular-shaped locking ears through a corresponding circular aperture, thereby permitting the handle to pivot about the circular apertures.

2. A package box capable of being folded for use and unfolded for storage, and formed of moisture proof and printable material, which box comprises:

(a) a first sheet formed of plastic material and provided with a plurality of engagable ear and slit assemblies which may be detachably engaged for securing the first sheet in a folded position to form a cylindrical-shaped box, the upper and lower ends of the box being provided with a plurality of circumferentially spaced slits and a pair of circular apertures in opposed wall portions of the box;

(b) second and third sheets formed of plastic material for defining the top and bottom of the box, each of the second and third sheets being provided with a plurality of outwardly extending tabs engageable within the circumferentially spaced slits of the first sheet;

(c) a fourth sheet formed of plastic material and in the configuration of an elongate strap for defining a handle, each end of the strap including a pair of oppositely directed semicircular slits defining a pair of inwardly foldable semicircular-shaped locking ears; and (d) each end of the handle being securable to the box by inserting each pair of semicircular locking ears through a corresponding circular aperture, thereby permitting the handle to pivot about the circular apertures.

* * * * *